US005224033A

United States Patent [19]

Nakamura et al.

[11] Patent Number: 5,224,033

[45] Date of Patent: Jun. 29, 1993

[54] WORK AUTOMATION APPARATUS FOR HYDRAULIC DRIVE MACHINES

[75] Inventors: Kentaro Nakamura, Hiratsuka; Takao Kamide, Oiso; Kiyoshi Note, Ninomiya; Koichi Yamashita, Hiratsuka; Shinji Maeda, Isehara, all of Japan

[73] Assignee: Kabushiki Kaisha Komatsu Seisakusho, Tokyo, Japan

[21] Appl. No.: 635,630

[22] PCT Filed: Sep. 28, 1989

[86] PCT No.: PCT/JP89/00986

§ 371 Date: Jun. 5, 1991

§ 102(e) Date: Jun. 5, 1991

[87] PCT Pub. No.: WO91/05113

PCT Pub. Date: Apr. 18, 1991

[30] Foreign Application Priority Data

Sep. 26, 1989 [JP] Japan ..... 1-250045

[51] Int. Cl.[5] ..... G06F 15/20

[52] U.S. Cl. ..... 364/167.01; 364/DIG. 1; 364/180; 364/193; 364/424.07; 364/508; 172/2

[58] Field of Search ..... 364/167.01, 424.07, 364/180, 191-193, 508; 56/10.2, DIG. 15; 172/2, 4, 4.5; 37/DIG. 1

[56] References Cited

U.S. PATENT DOCUMENTS 4,187,454 2/1980 Ito et al. ..... 364/193 X
4,481,591 11/1984 Spongh ..... 364/193 X
4,639,868 1/1987 Tanaka et al. ..... 364/424.07 X
4,715,012 12/1987 Mueller, Jr. ..... 364/424.07 X
4,866,641 9/1989 Nielsen et al. ..... 364/424.07 X
5,065,326 11/1991 Sahm ..... 364/424.07

FOREIGN PATENT DOCUMENTS 58-24036 2/1983 Japan .
59-68445 4/1984 Japan .
59-220534 12/1984 Japan .
60-33940 2/1985 Japan .
61-296406 12/1986 Japan .

*Primary Examiner*—Joseph Ruggiero
*Attorney, Agent, or Firm*—Richards, Medlock & Andrews

[57] ABSTRACT

A hydraulic actuator is operated using a manual operation device, operations from the manual operation device are stored in the path of an operation signal to a valve controller and these are read out as required and operations similar to those from the manual operation device are outputted to the hydraulic actuator so that repeated operations of the hydraulic actuator are performed automatically. Further, a vibration signal to the hydraulic actuator is added to the operation by the manual operation device and outputted so that operation that is not accurately performed by manual operation is made possible. In the case where repeated operations are performed continuously, a correction operation by the manual operation device is taken into account so that a correction operation which is varied every given amount is made simple. Thus, the present invention can be used where the digging process of a construction machine is made deeper every given amount.

18 Claims, 4 Drawing Sheets

WORK AUTOMATION APPARATUS FOR HYDRAULIC DRIVE MACHINES

TECHNICAL FIELD

The present invention relates to a work automation apparatus for hydraulic drive machines and, in particular, to one mounted on hydraulic drive machines for a construction machine or the like that repeatedly operates hydraulic machines in accordance with lever operations to be performed by the operator, or which performs a plurality of combination operations automatically so as to improve workability.

BACKGROUND ART

In recent years, electronic technology has developed remarkably, and the electronic-hydraulic control system shown in FIG. 5 has come to be adopted in the operation of cylinders for a work machine like a construction machine or the like in place of a mechanical or hydraulic lever control system.

In the conventional electronic-hydraulic control system shown in FIG. 5, the operation amount of an electric lever 101 which the operator manipulates is converted to an electrical signal and inputted to an electronic controller 102. The electronic controller 102 outputs a signal corresponding to the operation amount of the electrical lever 101 to the two end solenoids 103*a* and 103*b* of an electronic control hydraulic valve 103. The electronic control hydraulic valve 103 supplies a quantity of oil corresponding to the operation amount of the electric lever 101 to a hydraulic actuator 105 via hydraulic pipes 104*a* and 104*b* using a pump 106 so as to operate a rod 105*a*. According to this, fine control can be effected with simplified operation, and operation which is impossible by a mechanical and hydraulic operation is made possible.

However, although the conventional technology shown in FIG. 5 has the merit of electronic control, a problem exists in that the fatigue of the operator is extremely great in a case where the operation of two- or more-axle levers such as comb-off digging by a hydraulic power shovel or the like is performed. In addition, it is very difficult to vibrate a bucket while performing digging. That is, where comb-off digging is performed using a hydraulic power shovel, each work machine consisting of a boom, an arm and a bucket must be operated using hydraulic cylinders. Sediment must be dug out so that the surface of land becomes level or becomes a plane inclined at a given angle. To perform this work, the operator must operate each work machine while paying attention to the quantity of sediment in the bucket and the absolute angle (angle with respect to the digging plane) so as to be level. What is more, to compact the ground to be leveled, only a bucket, which is specifically one work machine, must be vibrated up and down at a predetermined amplitude and frequency. This work cannot be improved merely by the above-mentioned conventional technique. Hence, it has been a problem to be able to obtain a uniform work result at any time without depending on the experience of the operator. Further, in the above-mentioned comb-off digging and ditch digging work, repeated digging must be performed up to a predetermined depth. Even in such simple repeated work, the operator himself must directly operate repeatedly, and therefore reducing the work in such a case has been a problem.

The present invention has been devised in light of the above-mentioned conventional problems. The first object of the present invention is to provide a work automation apparatus for hydraulic drive machines which are capable of performing repeated operations automatically. The second object of the present invention is to provide a work automation apparatus for hydraulic drive machines which is capable of reducing a correction operation by correcting an automatic operation through the intervention of a lever operation during automatic operation to make as much correction as the amount of the lever operation intervention and to play it back so as to start operation again at the correction position immediately preceding without starting at the initial position again during repeated automatic operation.

DISCLOSURE OF THE INVENTION

In order to achieve the above-mentioned objects, a work automation apparatus for hydraulic drive machines in accordance with a first embodiment of the present invention comprises a manual operation means, a hydraulic actuator which communicates with a hydraulic source, a control valve which is disposed in the supply and discharge passages to the hydraulic actuator and which makes an opening/closing restrictor for the above supply and discharge passages by an electromagnetic drive means such as a solenoid mechanism or the like, a valve controller for outputting a drive signal in proportion to the operation signal of the above-mentioned manual operation means to this control valve, an automatic work controller having a memory section for inputting an operation signal from the manual operation means and for storing this signal and having a computation output section which allows a drive signal to be outputted to the above valve controller on the basis of a storage signal in the memory section, and a switching means for selecting output from the manual operation means and from the automatic work controller and for outputting it to the valve controller.

In an example of the second embodiment, an automatic work controller has a vibration signal generation section for generating a vibration signal corresponding to a forward/reverse drive signal for a hydraulic actuator, and the above-mentioned computation output section can combine a vibration signal from the vibration signal generation section and a storage signal in the above-mentioned memory section and output it to the valve controller. In an example of the third embodiment, the computation output section of the automatic work controller has an addition section for adding an operation signal from a manual operation means and updating storage data in the memory section so that an automatic work correction process can be performed.

The action of a hydraulic actuator designed in this manner will be as follows: First, a manual operation means is manipulated beforehand to directly drive a hydraulic actuator. This becomes a model operation, and the automatic work controller inputs an operation signal of the manual operation means and stores it in the memory section. When the output side to the valve controller is switched by a switching means from a manual operation means to the automatic work controller side in order to perform automatic work, the computation output section of the automatic work controller reads in stored data from the memory section. An operation signal similar to an operation signal by manual operation means performed earlier is outputted to the valve controller, and the hydraulic actuator performs the same operation as the operation taught earlier. Therefore, to make the hydraulic actuator perform the same operation repeatedly, the automatic work controller is made to store operations by a first teaching function. By switching operation outputs with the switching means the second time or later, work can be repeated automatically without being directly driven by the operator.

According to the second embodiment, a vibration signal generation section for generating a signal corresponding to a forward/reverse drive signal to the hydraulic actuator is provided in the above-mentioned automatic work controller. Therefore, a signal having constant amplitude and constant frequency is generated from the vibration signal generation section. The computation output section accepts a vibration signal from this vibration signal generation section and outputs this vibration signal as a single signal, or it can combine this vibration signal with a storage signal in the above-mentioned memory section and output it to the valve controller. Hence, the hydraulic actuator performs an operation in accordance with the operation from the manual operation means while performing a forward/reverse operation. This means that when the hydraulic actuator is, for example, used to drive the bucket of a hydraulic power shovel using a flexible oil-pressure cylinder means, an automatic drive can be performed so as to automatically perform only the oscillating action or to scratch off and move in a predetermined direction while causing the bucket to oscillate. When a bucket is made to perform an oscillating action manually, an accurate continuous operation cannot be performed. However, the present invention can perform it properly, and the operator should pay attention only to the movement direction.

Further, in the third embodiment, the computation output section of the automatic work controller adds an operation signal from the manual operation means and updates stored data in the above-mentioned memory section. For this reason, the computation output section does not return to an initial state at teaching time during automatic work and reruns with the previous process as a starting point, and therefore correction processes during each automatic work are diminished. Thus, in a case of comb-off work, when the depth of a created plane is made deeper as it is repeated, the correction amount becomes larger as it is repeated. However, since the present invention is of a correction restorage system, the operation required for correction hardly varies each time and fine adjustments thereof are easy.

THE BEST MODE FOR CARRYING OUT THE INVENTION

An embodiment of the work automation apparatus for hydraulic drive machines of the present invention will be explained in detail hereinunder with reference to the accompanying drawings.

Figure 1:
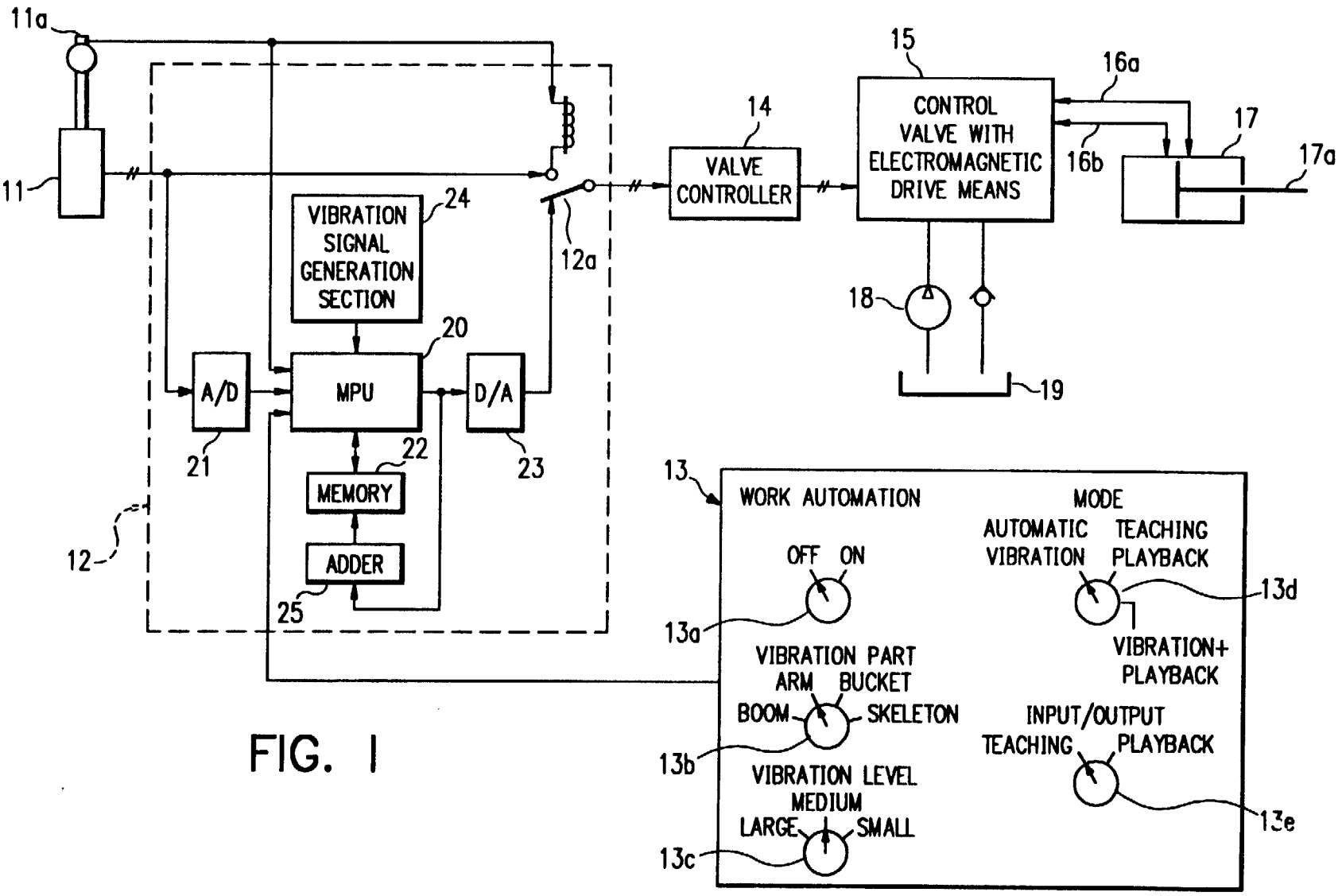
FIG. 1 is a block diagram illustrating the configuration of a work automation apparatus for hydraulic drive machines of an embodiment of the present invention.
Figure 2:
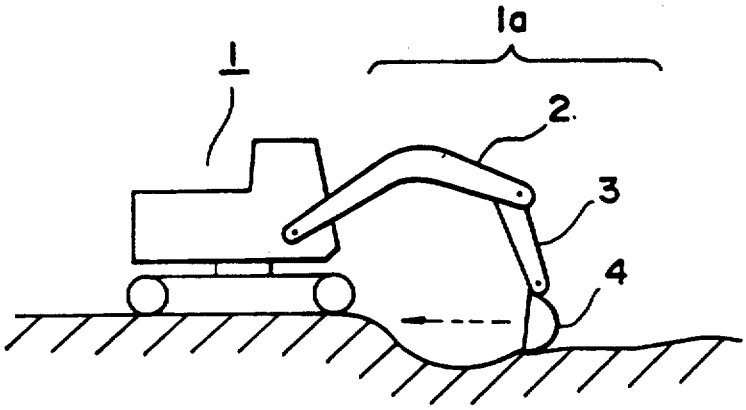
FIG. 2 is a view illustrating a state in which soil is dug by a hydraulic power shovel.

FIG. 1 is a block diagram of the embodiment of the work automation apparatus for hydraulic drive machines. FIG. 2 is a side view illustrating the working state of a hydraulic power shovel in which a work automation apparatus for this hydraulic drive machine is used.

As shown in FIG. 2, a work machine 1a of a hydraulic power shovel 1 in which the work automation apparatus for hydraulic drive machines is carried comprises a boom 2, and arm 3, and a bucket 4. To perform comb-off work, the boom 2, the arm 3 and the bucket 4 are each operated using an operation lever. The work automation apparatus for hydraulic drive machines for operating the work machine 1a of the hydraulic power shovel 1 has an electric operation lever 11 as a manual operation means. This lever is an operation lever for operating the boom 2, the arm 3 and the bucket 4 of the hydraulic power shovel 1. For example, when a certain lever is pushed down and in a forward direction, the boom 2 is lowered; when the lever is pushed down and in a backward direction, the boom 2 is raised; when the lever is pushed down and to the left, the arm 3 is extended; when the lever is pushed down and to the right, the arm 3 is retracted. Thus, four kinds of operations can be performed by one lever. The operation amount by this operation lever 11 is converted to an electrical signal and outputted to the valve controller 14 via an automatic work controller 12. At this point, an operation signal in proportion to the operation amount by the operation lever is outputted to a control valve 15. The control valve 15 is designed in the same way as in the example of the prior art. It has a control signal for opening/closing the flow path of pressure oil from a pump 18 as a hydraulic source and an electromagnetic solenoid for switching ports and for restricting pressure oil, making supply and discharge between itself and a working oil tank 19. Numeral 14 denotes a valve controller, which controls the control valve 15 in response to an electrical signal from the automatic work controller 12. The control valve 15 supplies pressure oil from the above-mentioned pump 18 to the hydraulic actuator 17 via a hydraulic pipe 16a or 16b, causing a rod 17a the operate.

The automatic work controller 12 is provided in the middle of a control passage between the above-mentioned operation lever 11 and the valve controller 14. This automatic work controller 12 is configured as follows. A connection relay contact point 12a is disposed between the input section for an operation signal from the operation lever 11 and the output section to the above-mentioned valve controller 14. This contact point 12a si driven by a push switch 11a attached to the operation lever 11. A selection as to connection is made; that is, whether output from the automatic work controller 12 is to be used as a direct operation signal from the operation lever 11 or as an output signal based on a control signal from a computation output section 20 described as follows. The computation output section 20 comprising the main processing unit in the automatic work controller 12 consists of a microprocessor unit (MPU), which inputs an operation signal outputted from the operation lever 11 as a digital signal via an A/D converter 21, inputs an operation signal for the operation lever 11 chronologically, and stores it in the memory section 22. The computation output section 20 is so designed that it reads out stored data chronologically from the memory section 22 via an output instruction and outputs it to the valve controller 14 via the above-mentioned relay contact point 12*a* through a D/A converter 23 so as to drive the control valve 15 according to the same procedure as followed in the operation by the operation lever 11 described above. In addition, the computation output section 20 has a vibration signal generation section 24. This vibration signal generation section 24 generates a pulse signal equivalent to a drive signal for causing the hydraulic actuator 17 to continuously perform forward/reverse drive. The computation output section 20 inputs an output signal from this vibration signal generation section 24 in response to the output instruction and makes it possible to output the signal singly or to add the signal to data stored in the memory section 22 and output it. An adder 25 is provided at the output side of the computation output section 20 so as to feed back the output to the memory section 22. Thus, with the final output data from the computation output section 20 as the up-to-date data, the stored contents of the memory section 22 are updated and an initial operation during repeated work is started at the last driven position.

On the other hand, a switch panel 13 is provided as a switch means in order to supply an input instruction to the automatic work controller 12 or the like. Mounted on it are a work automation switch 13*a*, a vibration part switch 13*b*, a signal level switch 13*c*, a mode switch 13*d*, and an input/output switch 13*e*. The work automation switch 13*a* selects whether the above-mentioned relay contact point 12*a* is to be used to place the operation lever 11 and the valve controller 14 in a directly connected state, or the switching of the relay contact point 12*a* is made possible so as to allow automatic work by the automatic work controller 12. The vibration part switch 13*b* selects an object for a vibration operation and instructs the computation output section 20 to regard a boom, an arm, a bucket, or both an arm and a bucket as a vibration object. The signal level switch 13*c* sets an amplitude by means of the above-mentioned vibration signal generation section 24, which can be achieved by slicing, with a set level, an input level from the vibration signal generation section 24 using the computation output section 20. The mode switch 13*d* selects each node of a vibration drive, a teaching operation and its playback operation, or a vibration operation and a playback operation. Further, the input/output switch 13*e* selects a teaching operation using the operation lever 11 or a playback operation according to an output from the computation output section 20. The selection of these at will causes the computation output section 20 to compute and output in accordance with the set instruction.

Figure 3:
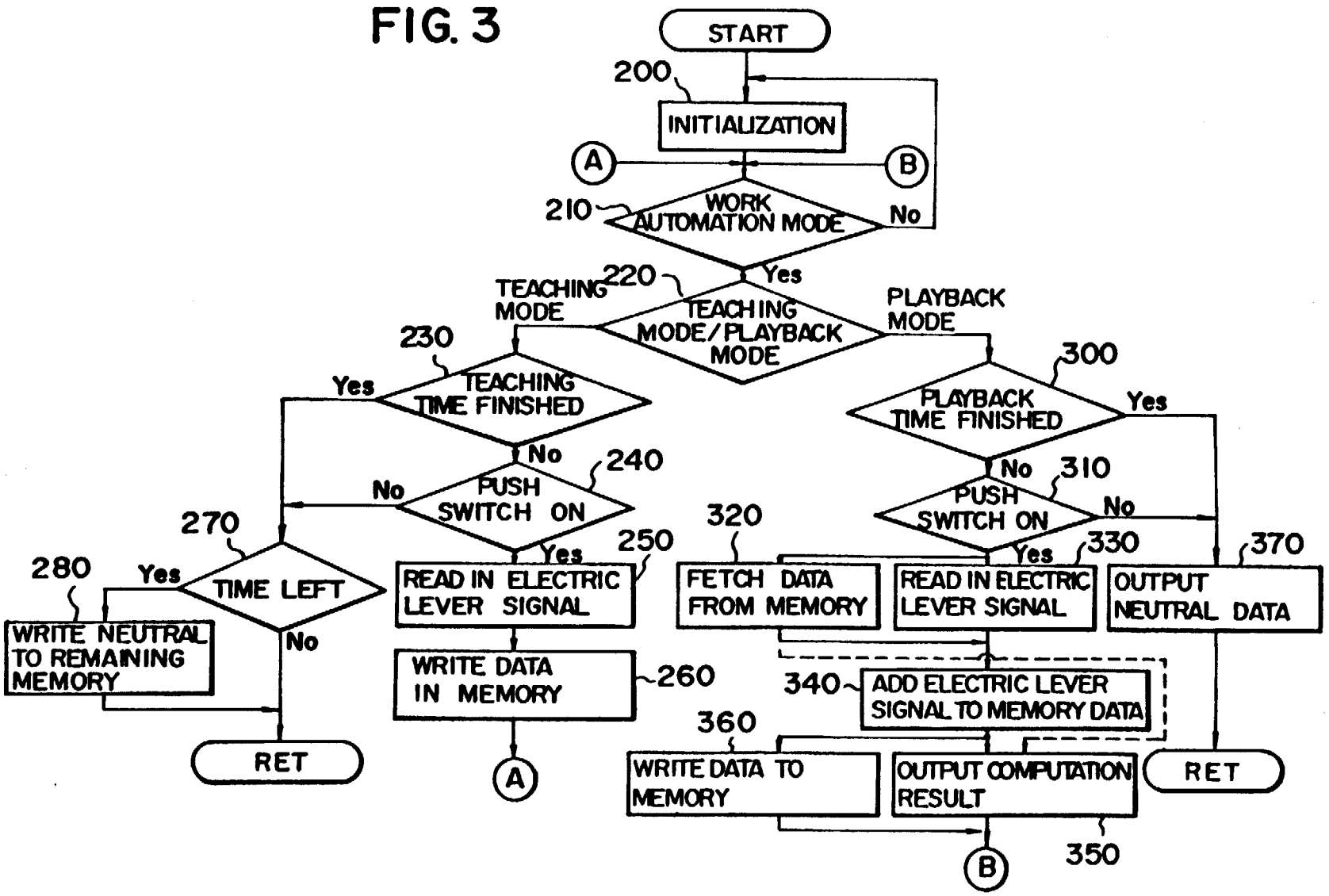
FIG. 3 is a flowchart for work by the same apparatus.
Figure 5:
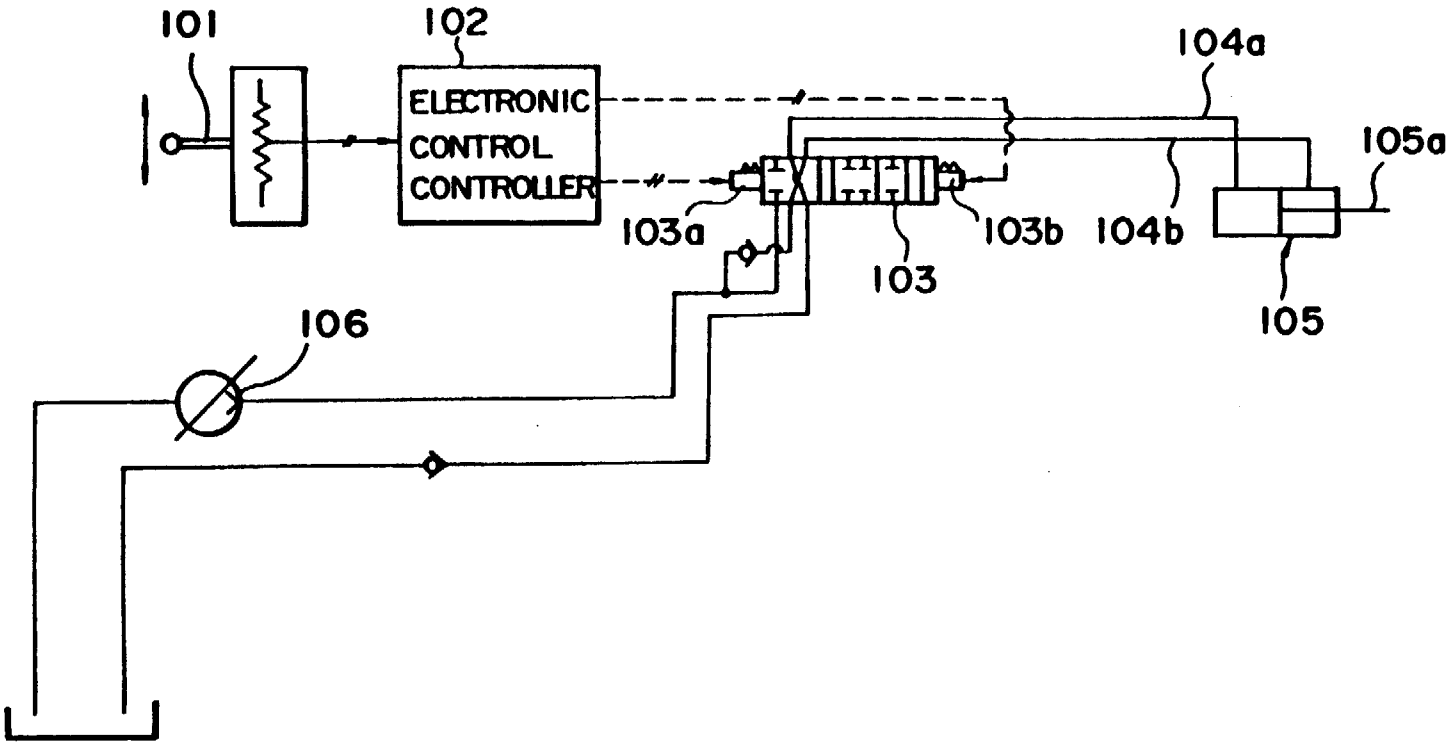
FIG. 5 (PRIOR ART)
FIG. 5 is a block diagram illustrating the configuration of the lever control apparatus of a hydraulic actuator of the prior art.

The operation of the work automation apparatus for this kind of hydraulic drive machines will be explained with reference t the flowchart shown in FIG. 3. First, initialization is performed using the switch panel 13 which is a switching means (step S200). A work automation switch 13*a* of the switch panel 13 is set to the ON position. Next, the mode switch 13*d* is set to the teaching/playback position and the input/output switch 13*a* is set to the teaching position. Then, a check of the work automation switch 13*a* is made (step S210). In a case where it is ON, the mode switch 13*d* is checked and at the same time, the mode of the input/output switch 13*e* is checked (step S220). In the case of the teaching mode, first, it is checked to see whether or not teaching time is finished using a timer contained in the automatic work controller 12 (step S230). If not finished, it is checked to see whether or not the push switch 11*a* of the operation lever 11 is ON (step S240). An actual operation in this state is performed in such a way that while holding down the push switch 11*a* of the operation lever 11, the operation lever 11 is operated, causing an electrical signal to be generated and the rod 17*a* of the hydraulic actuator 17 is driven by controlling the control valve 15 via the automatic work controller 12 and the valve controller 14. If the push switch 11*a* is turned on in this state, the process proceeds to a storage operation and the computation output section 20 reads in the operation of the operation lever 11 (step S250). Data is then stored in the memory section 22 and the process returns to step S200 (step S260). If time is finished in steps S230 and S240 and the push switch 11*a* is OFF, the remaining time is checked (step S270). If time remains, the fact of being neutral is written in the remaining memory area (step S280) and the process returns to step S200.

On the other hand, in the playback mode, the process will be as in the following. With a work machine, actuated by the operation of the rod 17*a* of the hydraulic actuator 17, set-to a position in which the process proceeds to the storage operation, the work automation switch 13*a* of the switch panel 13 is set to the ON position and the input/output switch 13*e* is set to the playback position. This is checked in step S220 and it is first checked to see whether or not the playback time is finished (step S300). Then, it is checked to see whether or not the push switch 11*a* of the operation lever 11 is pressed (step S310). When it is on, an electrical signal, generated in response to the operation amount of the operation lever 11 and stored in the automatic work controller 12, is read out (step S320) which controls the control valve 15 directly via the automatic work controller 12 and the valve controller 14 as required to operate the rod 17*a* of the hydraulic actuator 17 and to operate the work machine la (step S350). At this point, when correcting the movement of the work machine la, if the operation lever 11 is operated in a direction in which the work machine 1*a* is moved, the operation amount of the operation lever 11 is added and the work machine 1*a* is moved. The operation amount of the operation lever 11 is also added and stored in the automatic work controller 12 (steps S330 and S340). In addition, during the output process in step S350, the output data is overwritten in the memory section 22 via the adder 25 to update the contents of the memory (step S360). When time is finished or the push switch 11*a* is off in the above steps S300 and S310, neutral data is outputted (step S370) and the process returns to step S210. Therefore, when the second playback operation is performed next, since the electrical signal, by which the operation lever 11 is operated during the last playback operation and the movement of the work machine 1*a* is updated, has been stored, the same operation is played back as when the movement of the work machine is updated during the last playback operation.

Basically, the operation is as described above. The operation will be as follows in the playback operation and the automatic vibration modes.

First, with the work machine 1a, which is moved by the operation of the rod 17a of the hydraulic actuator 17, set to the position where it enters a storage operation, the work automation switch 13a of the switch panel 13 is set to the ON position, the input/output switch 13e is set to the playback position, and the mode switch 13d is set to the vibration + playback position. Next, where it is desired to vibrate a specific vibration part, for example, a bucket, the vibration part switch 13b is set to the position of the bucket.

Next, the signal level switch 13c is adjusted to a vibration level, for example, to "large" for a strong vibration, "small" for a small vibration, and "medium" for an intermediate vibration.

Next, when the push switch 11a of the operation lever 11 is pressed, the work machine 1a moves and vibrates according to signals stored in the automatic work controller 12.

Next, an automatic vibration will be explained.

The work automation switch 13a of the switch panel 13 is set to the ON position, and further the mode switch 13d is set to the automatic vibration position. Then, the vibration part switch 13b is set to the setting where the work machine 1a is desired to vibrate, for example, it is set to the position of the bucket when it is desired to vibrate the bucket 4. Next, the vibration level switch 13c is adjusted to the level of a vibration, for example, to "large " for a strong vibration, "small" for a small vibration, and "medium" for an intermediate vibration. Next, when the push switch 11a of the operation lever 11 is pressed, the work machine vibrates at a position set by the vibration part switch 13b. In addition, by operating the operation lever 11, vibration can be added while performing normal work.

Figure 4:
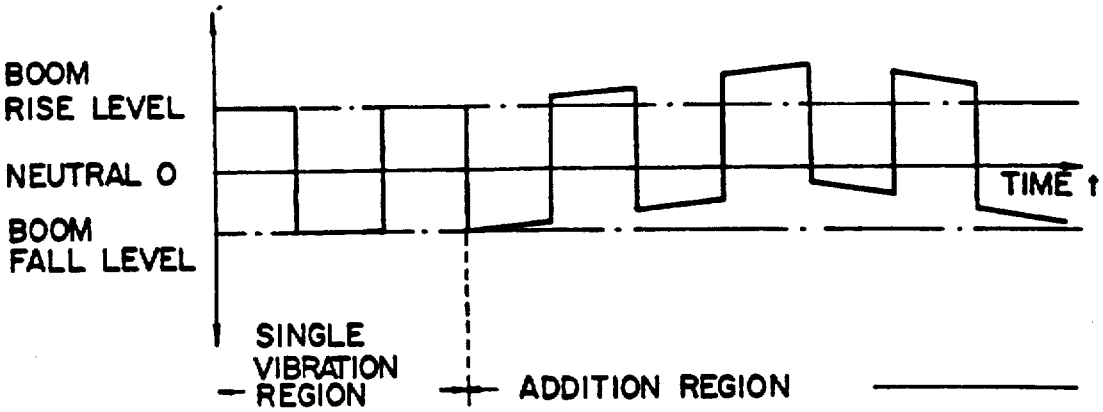
FIG. 4 is a view of an output signal in the case where vibration and playback operation are added to the operation of the boom of the hydraulic power shovel.

The case where the relation between the automatic vibration mode and the playback mode is applied to the hydraulic shovel boom is shown in FIG. 4.

As shown in the figure, if the automatic vibration mode is merely given to an actuator for booms, an upward and downward movement is repeated at a constant frequency and amplitude (single oscillation region). If the playback mode is added to this, the boom moves upward and downward at a high frequency while vibrating automatically (addition region). As a result, it can be understood that the boom can be made to perform a fine upward movement and vibration in addition to the overall movement of the boom. Therefore, compaction by a comb-off operation and continuous striking of the ground can be performed automatically.

INDUSTRIAL APPLICABILITY

The present invention can be used in hydraulic actuators of a hydraulic cylinder, a hydraulic motor or the like and, in particular, preferably in the case of a drive operation by means of a manual operation means. Possible applications thereof are hydraulic drive machines of a construction machine or the like such as a hydraulic power shovel, a hydraulic actuator or the like operated via a manipulator.

What is claimed is:

1. A work automation apparatus for hydraulic drive machines, comprising:

a manual operation means for producing an operation signal;

a source of hydraulic fluid;

a hydraulic actuator;

a supply and discharge passage means connected between said source and said hydraulic actuator;

a control valve disposed in said supply and discharge passage means and which makes an opening/closing restrictor for the supply of hydraulic fluid from said source to said hydraulic actuator and for the discharge of hydraulic fluid from said actuator;

an electromagnet drive means for actuating said control valve;

a valve controller for outputting a drive signal to said drive means responsive to an input signal to the valve controller;

an automatic work controller having a memory section for inputting an operation signal from said manual operation means and for storing this inputted operation signal, and having a computation output section which allows an automatic work signal to be outputted on the basis of a signal stored in the memory section; and a switching means for selecting said operation signal from said manual operation means or said automatic work signal from said automatic work controller, and for outputting the thus selected signal to said valve controller as the input signal thereto;

wherein said automatic work controller has a vibration signal generation section for generating a vibration signal corresponding to a forward/reverse drive signal for a hydraulic actuator, and said computation output section includes means for combining a vibration signal from the vibration signal generation section and a signal stored in said memory section and outputting the thus combined signal to said switching means.

2. A work automation apparatus for hydraulic drive machines in accordance with claim 1, wherein said vibration signal has a predetermined amplitude and frequency.

3. A work automation apparatus for hydraulic drive machine in accordance with claim 1, further comprising a vibration level selection switch, and wherein said vibration signal generation section generates a pulse signal having a constant amplitude and a constant frequency equivalent to a drive signal for causing said hydraulic actuator to continuously perform forward/reverse drive and then converts said pulse signal to said vibration signal with an amplitude level selected in accordance with the position of said vibration level selection switch.

4. A work automation apparatus for hydraulic drive machines in accordance with claim 1, wherein said computation output section of the automatic work controller has an addition section for adding an operation signal from a manual operation means and updating signals stored in said memory section so that an automatic work correction process can be performed by the automatic work controller.

5. A hydraulic power shovel having a plurality of hydraulic work machines and a work automation apparatus, said hydraulic work machines including at least one of a boom, an arm, and a bucket, said work automation apparatus comprising:

a manual operation means for producing an operation signal for operation of at least one of said hydraulic work machines;

a source of hydraulic fluid;

a hydraulic actuator for actuating said at least one of said hydraulic work machines;

a supply and discharge passage means connected between said source and said hydraulic actuator;

a control valve disposed in said supply and discharge passage means and which makes an opening/closing restrictor for the supply of hydraulic fluid from said source to said hydraulic actuator and for the discharge of hydraulic fluid from said actuator;

an electromagnetic drive means for actuating said control valve;

a valve controller for outputting a drive signal to said drive means responsive to an input signal to the valve controller;

an automatic work controller for providing an automatic work signal; and a switching means for selecting one of said operation signal from said manual operation means and said automatic work signal from said automatic work controller, and for outputting the thus selected signal to said valve controller as the input signal thereto;

wherein said automatic work controller comprises a memory section for inputting an operation signal for said at least one of said hydraulic work machines from said manual operation means and for storing this inputted operation signal, a vibration signal generation section for generating a vibration signal corresponding to a forward/reverse drive signal for said hydraulic actuator, and a computation output section which allows an automatic work signal to be outputted on the basis of at least one of said vibration signal and a signal stored in the memory section.

6. A hydraulic power shovel in accordance with claim 5 wherein said automatic work controller further comprises means for combining a vibration signal from said vibration signal generation section and a signal stored in said memory section and outputting the thus combined signal to said switching means.

7. A hydraulic power shovel in accordance with claim 6 wherein said at least one of said hydraulic work machines is said bucket.

8. A hydraulic power shovel in accordance with claim 5 wherein said at least one of said hydraulic work machines is said arm and said bucket.

9. A hydraulic power shovel in accordance with claim 5 wherein said at least one of said hydraulic work machines is said boom.

10. A hydraulic power shovel in accordance with claim 5 further comprising a work automation apparatus for each of said hydraulic work machines.

11. A hydraulic power shovel in accordance with claim 5 further comprising a work automation apparatus for each of said boom, said arm, and said bucket.

12. A hydraulic power shovel in accordance with claim 5 wherein said work automation apparatus further comprises a vibration level selection switch, and wherein said vibration signal generation section generates a pulse signal having a constant amplitude and a constant frequency equivalent to a drive signal for causing said hydraulic actuator to continuously perform forward/reverse drive and then converts said pulse signal to said vibration signal with an amplitude level selected in accordance with the position of said vibration level selection switch.

13. A hydraulic power shovel in accordance with claim 5 wherein said computation output section of the automatic work controller has an addition section for adding an operation signal from a manual operation means and updating signals stored in said memory section so that an automatic work correction process can be performed by the automatic work controller.

14. A work automation apparatus for a hydraulic drive machine, comprising:

a manual operation means for producing an operation signal for said hydraulic drive machine;

a source of hydraulic fluid;

a hydraulic actuator;

a supply and discharge passage means connected between said source and said hydraulic actuator;

a control valve disposed in said supply and discharge passage means and which makes an opening/closing restrictor for the supply of hydraulic fluid from said source to said hydraulic actuator and for the discharge of hydraulic fluid from said actuator;

an electromagnetic drive means for actuating said control valve;

a valve controller for outputting a drive signal to said drive means responsive to an input signal to the valve controller;

an automatic work controller for providing an automatic work signal; and a switching means for selecting one of said operation signal from said manual operation means and said automatic work signal from said automatic work controller, and for outputting the thus selected signal to said valve controller as the input signal thereto;

wherein said automatic work controller comprises a memory section for inputting an operation signal for said hydraulic work machine from said manual operation means and for storing this inputted operation signal, a vibration signal generation section for generating a vibration signal corresponding to a forward/reverse drive signal for said hydraulic actuator, and a computation output section which allows an automatic work signal to be outputted on the basis of at least one of said vibration signal and a signal stored in the memory section.

15. A work automation apparatus for a hydraulic drive machine in accordance with claim 14 wherein said automatic work controller further comprises means for combining a vibration signal from said vibration signal generation section and a signal stored in said memory section and outputting the thus combined signal to said switching means.

16. A work automation apparatus for a hydraulic drive machine in accordance with claim 14, wherein said vibration signal has a constant amplitude and frequency.

17. A work automation apparatus for a hydraulic drive machine in accordance with claim 14, further comprising a vibration level selection switch, and wherein said vibration signal generation section generates a pulse signal having a constant amplitude and a constant frequency equivalent to a drive signal for causing said hydraulic actuator to continuously perform forward/reverse drive and then converts said pulse signal to said vibration signal with an amplitude level selected in accordance with the position of said vibration level selection switch.

18. A work automation apparatus for a hydraulic drive machine in accordance with claim 14, wherein said computation output section of the automatic work controller has an addition section for adding an operation signal from said manual operation means and updating signals stored in said memory section so that an automatic work correction process can be performed by the automatic work controller.

* * * * *

UNITED STATES PATENT AND TRADEMARK OFFICE

CERTIFICATE OF CORRECTION

PATENT NO. : 5,224,033

DATED : June 29, 1993

INVENTOR(S) : Kentaro NAKAMURA et al

It is certified that error appears in the above-identified patent and that said Letters Patent is hereby corrected as shown below:

Column 8, line 8, change "electromagnet" to --electromagnetic--.

Column 8, line 40, change "machine" to --machines--.

Signed and Sealed this

Eighth Day of March, 1994

*Attest:*

*Attesting Officer*

BRUCE LEHMAN

*Commissioner of Patents and Trademarks*